US005838879A

United States Patent [19]

Harris

[11] Patent Number: 5,838,879

[45] Date of Patent: Nov. 17, 1998

[54] CONTINUOUSLY CLEANED PRESSURELESS WATER HEATER WITH IMMERSED COPPER FLUID COIL

[75] Inventor: Howard Harris, Ashland City, Tenn.

[73] Assignee: Howard Harris Builders, Inc., Ashland City, Tenn.

[21] Appl. No.: 579,424

[22] Filed: Dec. 27, 1995

[51] Int. Cl.[6] ..... F24H 1/22

[52] U.S. Cl. ..... 392/451; 392/496; 392/481; 126/344

[58] Field of Search ..... 392/449–454, 392/456, 496, 447, 448, 481; 126/344, 361, 362; 122/13.1, 13.2

[56] References Cited

U.S. PATENT DOCUMENTS

| | | | |
|---|---|---|---|
| 491,320 | 2/1893 | Mitchell . | |
| 1,209,599 | 12/1916 | Le Fevre | 392/496 |
| 1,503,972 | 8/1924 | Berg . | |
| 1,561,276 | 11/1925 | Pankratz | 392/456 |
| 2,036,815 | 2/1936 | Leader . | |
| 2,044,573 | 6/1936 | Hornberger | 392/448 |
| 2,048,104 | 7/1936 | Clinefelter | 392/456 |
| 2,087,586 | 7/1937 | Tishman | 392/456 |
| 2,268,789 | 1/1942 | Watt . | |
| 2,435,981 | 2/1948 | Rawson | 392/447 |
| 2,481,813 | 9/1949 | Bede | 392/447 |
| 2,521,960 | 9/1950 | Arvintz et al. | 392/456 |
| 2,522,373 | 9/1950 | Jodell . | |
| 2,748,249 | 5/1956 | Collerati | 392/456 |
| 2,791,204 | 5/1957 | Andrus | 392/456 |
| 3,468,292 | 9/1969 | Ferraro . | |
| 3,492,446 | 1/1970 | Lawrence | 392/456 |
| 3,637,111 | 1/1972 | McCreary | 392/448 |
| 3,844,948 | 10/1974 | Burke et al. | 392/481 |
| 4,282,421 | 8/1981 | Hadar | 392/456 |
| 4,469,935 | 9/1984 | Candela . | |
| 4,529,032 | 7/1985 | Molitor . | |
| 4,628,184 | 12/1986 | West . | |
| 4,823,770 | 4/1989 | Loeffler | 126/362 |
| 5,228,413 | 7/1993 | Tam . | |

FOREIGN PATENT DOCUMENTS

| | | | |
|---|---|---|---|
| 669262 | 12/1938 | Germany | 392/451 |
| 3816497 | 11/1989 | Germany | 126/361 |
| 53999 | 6/1934 | Norway | 126/361 |
| 705617 | 3/1954 | United Kingdom | 392/450 |

*Primary Examiner*—John A. Jeffery

[57] ABSTRACT

A pressureless electric water heater for domestic use has a cylindrical double-walled tank for holding a quantity of a heat transfer liquid such as water. Cold water enters a copper coil immersed in the heat transfer liquid. The heat transfer liquid is heated by an electric heating element which extends down from a hinged tank top. Cold water flowing through the immersed coil is heated by the heat transfer liquid and exits the coil as hot water. The hinged top allows easy access to the interior of the tank and to the heating element, further easing access and replacement thereof. Sedimentation in the tank is minimized because the tank water is rarely replaced. Sedimentation in the coil is reduced because pressurized water flows through the coil when hot water is required and continuously cleanses the tubing.

8 Claims, 5 Drawing Sheets

CONTINUOUSLY CLEANED PRESSURELESS WATER HEATER WITH IMMERSED COPPER FLUID COIL

BACKGROUND OF THE INVENTION

1. Technical Field

This invention relates generally to electric water heaters for domestic use. More particularly, this invention relates to a compact electric water heater for domestic uses which is pressureless and continuously self-cleaning.

2. Background Art

The typical electric domestic water heater consists of a steel tank, insulated by fiberglass encased in a metal jacket. Cold water runs into the steel tank, is heated by lower and upper heating elements, and exits through a pipe. As hot water is drained off, cold water mixes with the remaining hot water, reducing the temperature of the remaining water and thereby reducing the efficiency of the heater.

Also, in a conventional electric water heater, minerals typically settle out from the water to form sediments, eventually reducing the heater's efficiency and causing corrosion and leaks. In addition, pressure is generated in the tightly sealed tank from heat and from occasional excessive water pressure entering the system from the cold water source. This pressure occasionally results in property damage and personal injury from steam and water leaving the pressure relief valve or from explosion from a failed valve.

The heating elements in conventional electric water heaters often fail before the tank and must be replaced. Because of the design of prior art domestic electric water heaters, replacement of the elements is a difficult task, usually requiring that the water supply be shut off and the tank drained prior to replacing the element.

SUMMARY OF THE INVENTION

One object of the electric water heater of this invention is to eliminate pressure inside the tank. This is accomplished by running the pressurized cold water that is to be heated through a copper coil. The copper coil which carries the cold water is immersed in a pressureless tank filled with non-recirculating water. The water in the tank is heated by, for example, an electric heating element. The heated tank water heats the copper coils which are thermally conductive. The pressurized cold water, i.e. tap water from a water supply, is heated as it circulates through the coils by thermal conductivity. Thus, cold water enters the coils, indirectly absorbs heat from the heated tank water, and exits the coils as hot water.

In a pressure tank, new sediment is carried into the tank by the water to be heated. In the pressureless tank of this invention, new sediment is rarely added. because the tank water is rarely replaced. Thus sediment buildup is reduced. The coil is continuously cleaned by the pressurized water running through it.

Because the tank of the water heater of this invention is not pressurized, the interior of the tank can be accessed without shutting off the water supply and draining the tank. Such access is required to replace a failed element.

In a preferred embodiment of the invention, the water heater comprises a double-walled cylindrical tank formed of plastic. The space between the inner and outer walls of the tank is insulated with foam. Water is heated in the tank by means of an electric heating element. Continuous copper coils are placed in the tank through which cold water enters and hot water exits. An overflow pipe, the cold water inlet and the hot water outlet are located above the water level of the tank in an air space below the top of the tank so that there are no holes in the tank to develop leaks. The heating element is mounted to an insulated plastic top which extends and protrudes down into the water located in the tank. The heating element is controlled by a thermostat in contact with the tank filled with water. Preferably, the top of the water heater is hinged so that the heating element is easily accessed for maintenance.

The continuously cleaned hot water heater of this invention will further provide more hot water more efficiently in a smaller and lighter tank. This will reduce energy usage, material costs, shipping and storage cost.

DESCRIPTION OF THE PREFERRED EMBODIMENT

Figure 1:
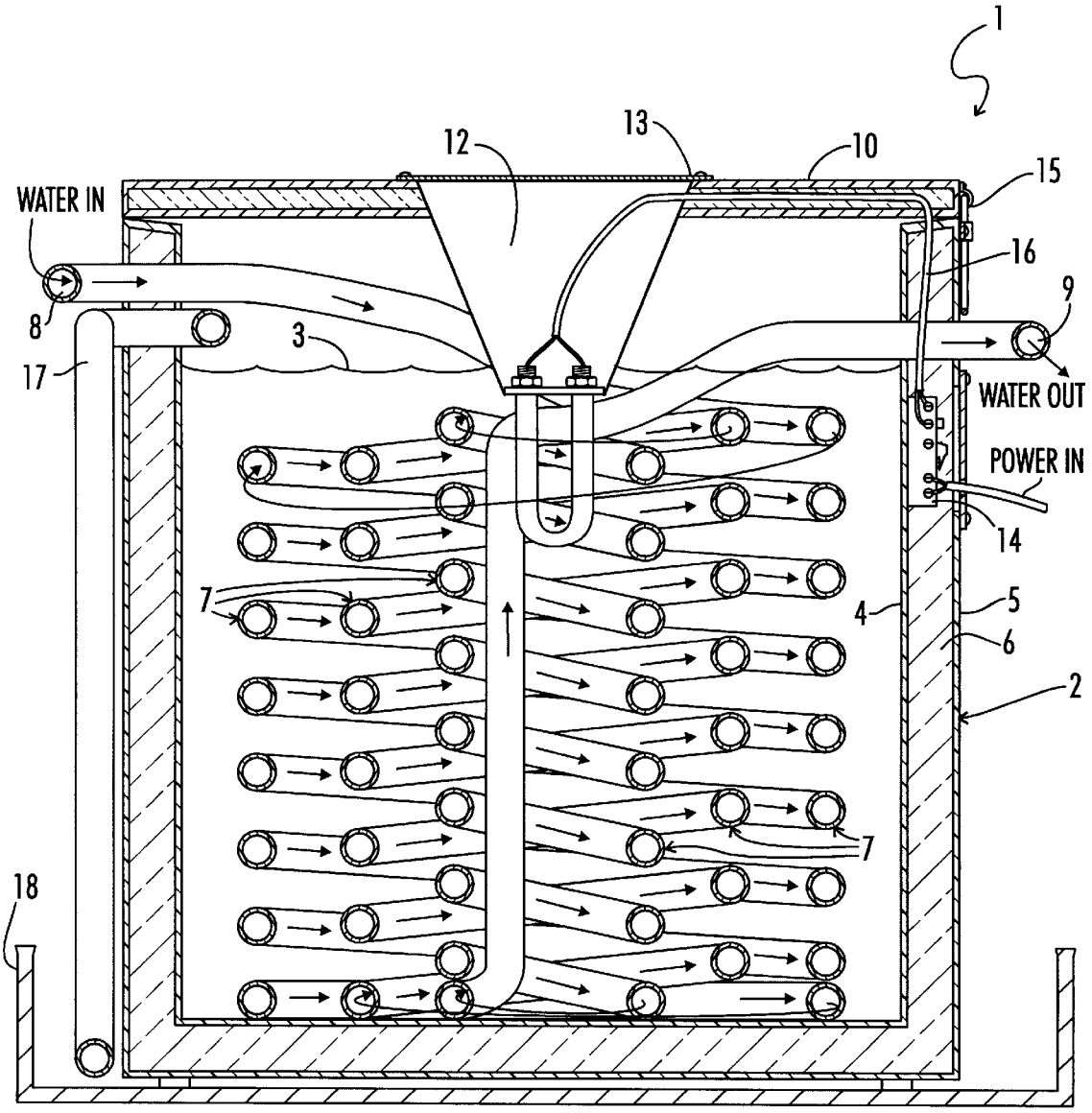
FIG. 1 is cross sectional side view of the water heater of this invention, showing the hinged top in the closed position.

Applicant's invention will be best understood when considered in light of the following description of a preferred embodiment of the invention as illustrated in the attached drawings wherein like reference numerals refer to like parts.

FIG. 1 shows the design of the continuously cleaned pressureless water heater, generally indicated by the reference numeral 1, and having a vertically oriented cylindrical tank 2, filled with water 3. The tank 2 is preferably formed with an inner wall 4 and an outer wall 5, spaced approximately two inches apart. The space between the walls 4 and 5 is filled with a foam thermal insulation 6.

Figure 2A:
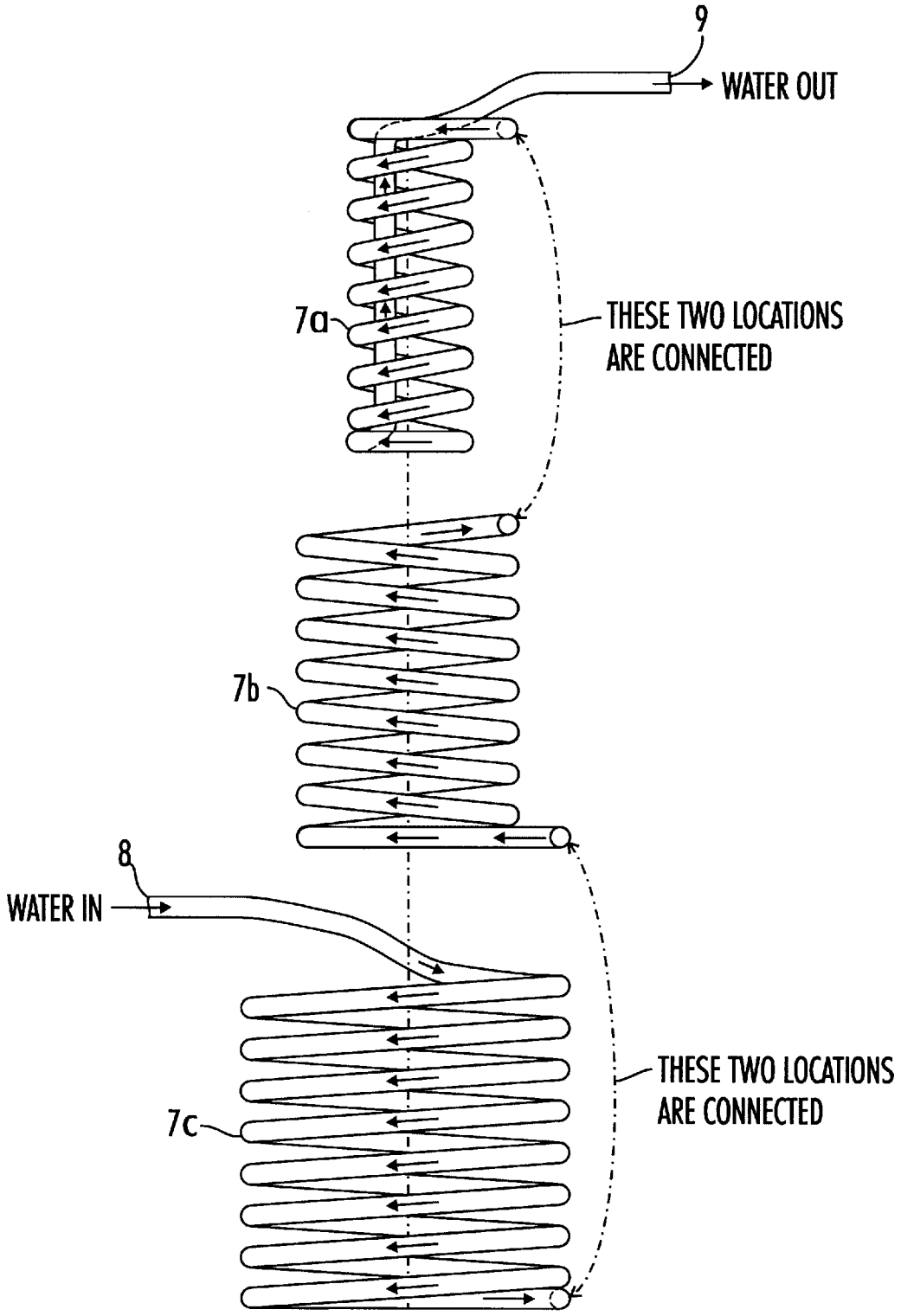
FIG. 2A is an exploded side view of the normally nested and interconnected coils used in the water heater of FIG. 1.
Figure 2B:
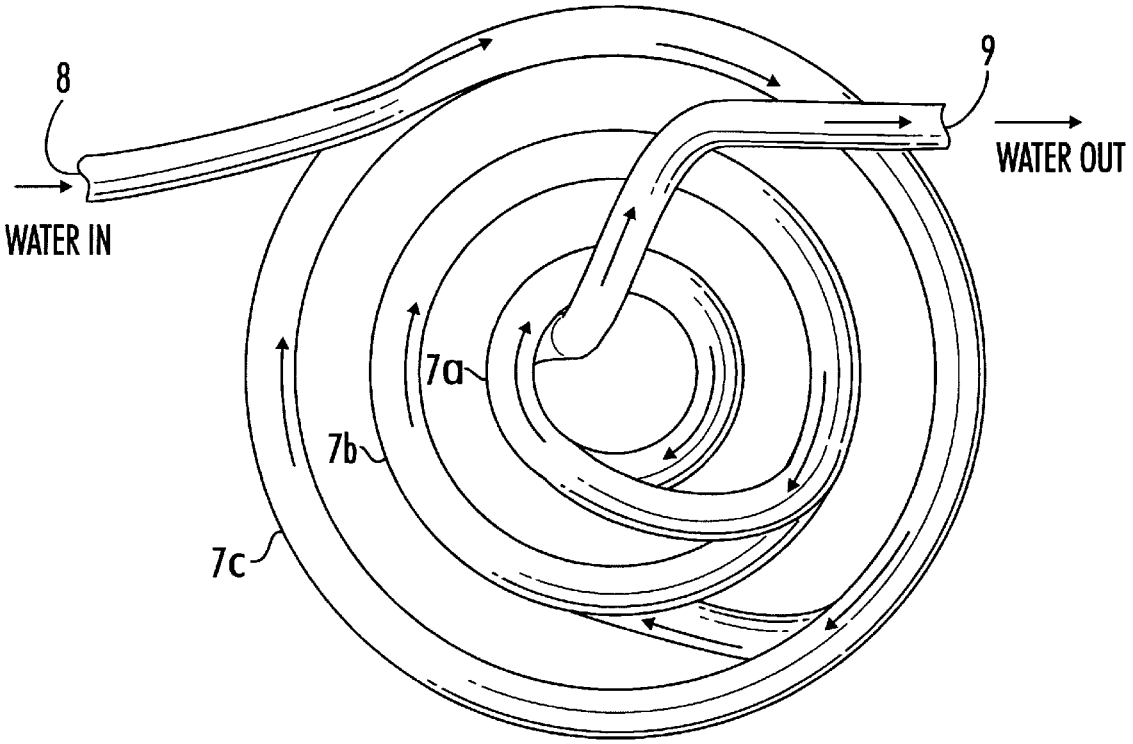
FIG. 2B is a top view of the coils shown in FIG. 2A, but in their nested and interconnected positions as shown in FIG. 1.

Positioned inside the tank 2 is a coil 7 of continuously connected copper tubing. As seen best in FIGS. 2A and 2B, the coil 7 is formed of multiple coil sections 7*a*, 7*b*, and 7*c* with each coil section 7*a–c* having a progressively increasing outside and inside diameter so that they can be nested and interconnected, as shown in FIG. 1. In a preferred embodiment, coil 7 will be formed of approximately 300 linear feet one-half inch OD copper tubing. The cold water to be heated inside the tank 2 enters the coil 7 at a cold water inlet 8, circulates through each coil section 7*a–c* successively, and exits the coil through the hot water outlet 9. The direction of water flow is indicated by directional arrows into the water inlet 8, along the outer surface of the coil 7, and out of the water outlet 17.

Looking again at FIG. 1, a thick double-walled top 10, preferably made of foam insulated plastic, supports a conventional electric heating element 11 which is secured to the top 10 and extends downward inside the tank 2 and beneath the surface of the tank water 3. The heating element 11 is attached to a conical plastic mount 12, which extends through the top 10, and is fastened to the top 10 by a screw-in plate 13. A thermostat 14, also of conventional design, is electrically connected by a control wire 16 which runs upwardly between the inner and outer walls 4 and 5 of the tank 2 and across inside the walls of the top 10. The thermostat controls electric power to the heating element 11 for regulation of the temperature of the tank water 3.

Figure 3:
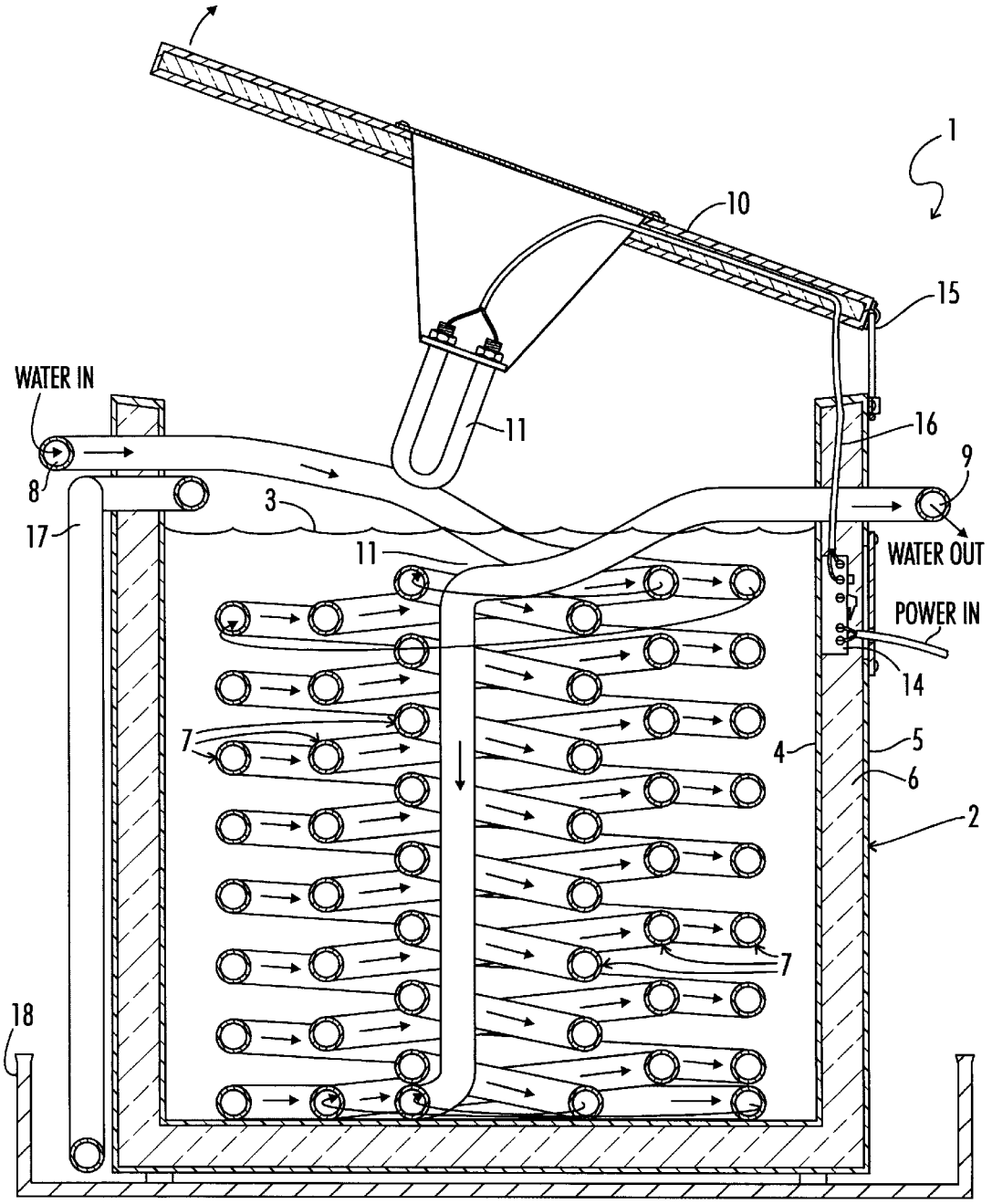
FIG. 3 is a cross sectional side view of the water heater of FIG. 1, showing the hinged top in the open position.
Figure 4:
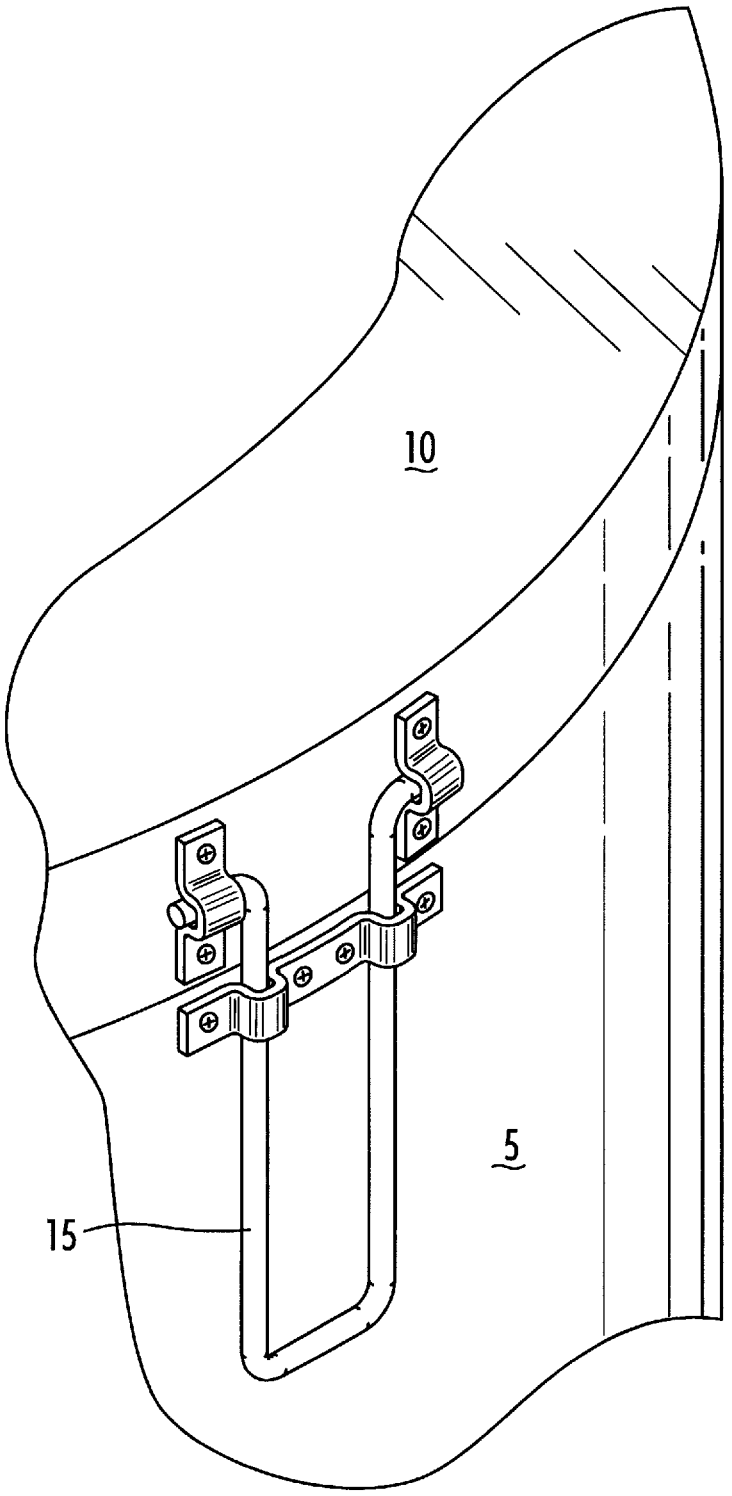
FIG. 4 is an enlarged perspective view of a section of the tank side wall and top of the water heater of FIG. 1, showing the connecting hinge

In accordance with another novel feature of the invention, the top 10 is attached to the tank 2 on one side by a hinge 15 so that the top 10 can be separated from the tank outer wall 5 by moving it from a closed position as shown in FIG. 1 to an open position as shown in FIG. 3. When the top 10 is in the open position, the heating element 11 can be easily accessed and replaced without having to shut-off the water supply or drain the tank 2. Almost any conventional hinge type can be used, with one example shown in FIG. 4 in which hinge 15 allows for both vertical and pivoting separation of the top 10 from the tank outer wall 5.

As seen in FIGS. 1 and 3, an overflow pipe 17 is located in the air space between the top surface of the tank water 3 and the top 10. The overflow pipe 17 runs to an overflow pan 18 in which the water heater 1 sits.

In one test performed, using less efficient materials than those described, twenty gallons of cold tap water (temperature not measured) were placed in the tank 2. The coil 7 consisted of 300 feet of ½ inch OD copper tubing. The thermostat 14 was set at 150 degrees. The tank water 3 was heated with one 4500 watt heating element 11. The water preheated for forty-five minutes. Forty gallons of water was then continuously drawn from the heater 1 with results as follows:

1. First five gallons—140 degrees
2. Second five gallons—125 degrees
3. Third five gallons—120 degrees
4. Fourth five gallons—115 degrees
5. Fifth five gallons—110 degrees
6. Sixth five gallons—105 degrees
7. Seventh five gallons 102 degrees
8. Eighth five gallons—98 degrees (3-¼ Kilowatts Used)

Thus, although there have been described particular embodiments of the present invention of a new and useful "CONTINUOUSLY CLEANED PRESSURELESS WATER HEATER WITH IMMERSED COPPER FLUID COIL", it is not intended that such references be construed as limitations upon the scope of this invention except as set forth in the following claims.

I claim:

1. An electric water heater comprising:

a. a water tank having a wall, a bottom and a tank top, the tank top adapted to be separated from the wall, the water tank adapted to hold a quantity of non-pressurized and non-circulating heat transfer liquid up to an upper liquid level that is below the tank top, to define an air gap region inside the tank between the upper liquid level and the top;

b. a thermally conductive coil mounted inside the tank and having a water inlet and a water outlet that each extend outwardly through the tank wall, whereby the tank top can be separated from the tank wall independently of the water inlet and water outlet;

c. an electric heating element attached to the tank top and extending downwardly through the air gap region in the tank and below the upper liquid level; and d. whereby the electric heating element contacts and heats the heat transfer liquid inside the tank and whereby the heat transfer liquid contacts the coil to heat water from a domestic water supply that enters the water inlet and circulates through the coil such that heated water leaves the water outlet and returns to the domestic water supply.

2. The water heater of claim 1 wherein the tank top is attached to the tank wall by a hinge such that the top can be separated from the tank wall by moving the top from a closed position to an open position whereby the heating element can be accessed without shutting off the domestic water supply or draining the heat transfer liquid.

3. The water heater of claim 2 wherein the tank wall comprises an inner tank wall and an outer tank wall separated by a first gap filled with thermal insulation.

4. The water heater of claim 3 wherein the inner and outer tank walls are made of a plastic material.

5. The water heater of claim 4 wherein the tank top has double-walls separated by a second gap filled with thermal insulation.

6. The water heater of claim 5 wherein the double walls of the tank top are made of a plastic material.

7. The water heater of claim 6 wherein the heat transfer fluid is water.

8. The water heater of claim 7 further comprising a thermostat electrically connected to the heating element by a control wire, the thermostat and a portion of the control wire are positioned inside the first gap and second gap.

* * * * *